US005331977A

United States Patent [19]

Draghetti

[11] Patent Number: 5,331,977

[45] Date of Patent: Jul. 26, 1994

[54] DISTRIBUTOR FOR CIGARETTE MANUFACTURING MACHINE

[75] Inventor: Fiorenzo Draghetti, Medicina, Italy

[73] Assignee: G. D. Societa' Per Azioni, Bologna, Italy

[21] Appl. No.: 5,224

[22] Filed: Jan. 15, 1993

[30] Foreign Application Priority Data

Jan. 15, 1992 [IT] Italy ..... BO92A000014

[51] Int. Cl.[5] ..... A24C 5/39

[52] U.S. Cl. ..... 131/109.1; 131/108; 222/271

[58] Field of Search ..... 131/109.1, 108, 110, 131/109.3, 84.1, 280; 222/410, 271, 272; 366/154, 155, 243, 297, 300, 315, 317

[56] References Cited

U.S. PATENT DOCUMENTS 4,185,644 1/1980 Heitmann et al. ..... 131/109.1 X
4,373,538 2/1983 Steiniger ..... 131/109.1
4,484,589 11/1984 Steiniger et al. ..... 131/109.1 X
4,681,124 7/1987 Hinzmann et al. ..... 131/109.1 X
4,911,182 3/1990 Dennis ..... 131/109.1
5,080,112 1/1992 Brackmann et al. ..... 131/109.1

FOREIGN PATENT DOCUMENTS 1074034 6/1967 United Kingdom .
2212706 8/1989 United Kingdom ..... 131/109.1

*Primary Examiner*—Jennifer Bahr
*Attorney, Agent, or Firm*—Marshall, O'Toole, Gerstein, Murray & Borun

[57] ABSTRACT

A cigarette manufacturing machine having a distributor including a duct, along which shredded tobacco is fed, and a withdrawal roller for withdrawing tobacco from the duct. The duct has a plurality of agitating disks rotatably mounted therein, each being reciprocatingly rotated about an axis perpendicular to the feed direction of tobacco through the duct and perpendicular to the rotation axis of the withdrawal roller and having an end portion inside the duct.

4 Claims, 2 Drawing Sheets

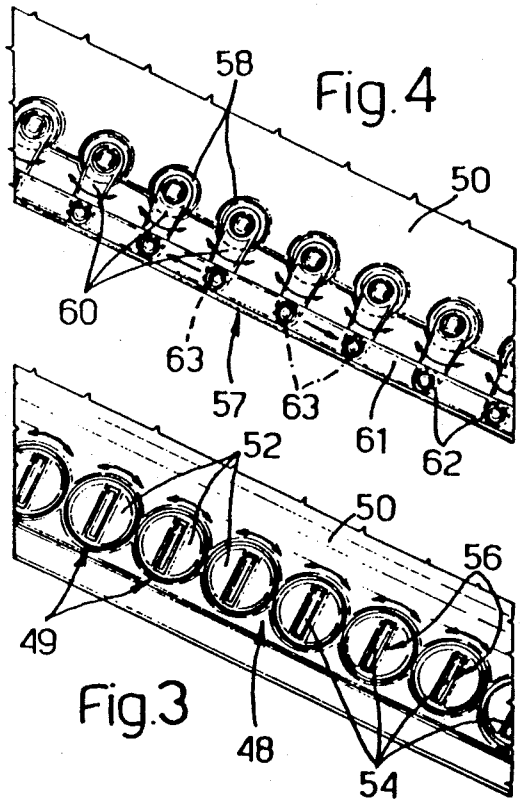
Fig. 4
Fig. 3
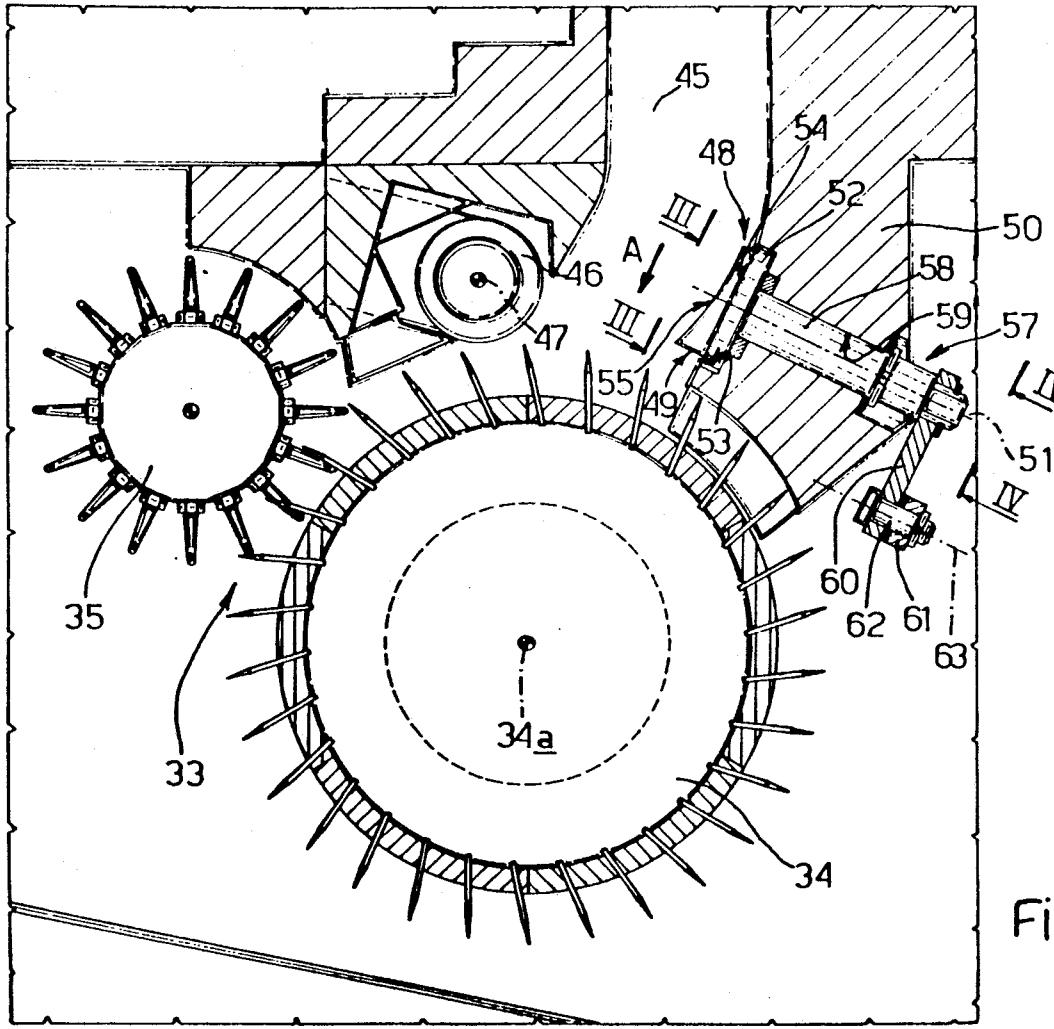
Fig. 2

DISTRIBUTOR FOR CIGARETTE MANUFACTURING MACHINE

BACKGROUND OF THE INVENTION

The present invention relates to a cigarette manufacturing machine.

Cigarette manufacturing machines are known to feature a distributor for receiving shredded tobacco from a feed device and feeding it, through a carding unit and drop-down duct, to a withdrawal unit by which the shredded tobacco is withdrawn from the bottom end of the drop-down duct and fed, in the form of a relatively thin layer, on to a conveyor belt. The layer of tobacco on the conveyor belt is then fed to the bottom end of an upfeed duct along which the tobacco particles are normally drawn up by suction and deposited on to the underside of one or more suction type conveyor belts forming part of a unit for producing at least one continuous cigarette rod.

The main requisite of a cigarette manufacturing machine is that the continuous cigarette rod be as homogeneous as possible, which in turn normally depends on the uniformity of the tobacco layer formed on the conveyor belt, and, consequently, on the regularity with which the tobacco is withdrawn from the bottom end of the drop-down duct, and the manner in which it is fed along the duct.

On known cigarette manufacturing machines, the drop-down duct normally presents a substantially rectangular section, with the long side extending perpendicular to the traveling direction of the conveyor belt. In particular, the drop-down duct presents at least one portion with a constant section, and at least one intermediate portion the section of which varies lengthwise along the duct.

Tests have shown such a design of the drop-down duct to present several drawbacks, by virtue of the tobacco fed into the duct remaining substantially unmixed and, more specifically, undergoing no change in density as it drops down the duct, so that any lack of uniformity in the original mass of tobacco is reflected in the tobacco layer formed on the conveyor belt. Moreover, by virtue of the geometry of the drop-down duct, the density of the tobacco supplied tends to vary not only from one section to another, but also within each section, which variation in density is noticeable in direct proportion to the ratio of the length of the long and short sides of the section.

SUMMARY OF THE INVENTION

It is an object of the present invention to provide a cigarette manufacturing machine having a distributor whereby the layer of tobacco formed on the conveyor belt is as homogeneous as possible.

According to the present invention, there is provided a cigarette manufacturing machine comprising a shredded tobacco distributor; said distributor in turn comprising a drop-down duct for said tobacco; means for feeding said tobacco to the inlet of said duct; and means for withdrawing said tobacco from the outlet of said duct; said withdrawal means comprising a withdrawal roller having its axis perpendicular to the feed direction of the tobacco in said duct; characterized by the fact that said distributor also comprises agitating means for a portion of and housed inside said duct; and activating means connected to and for moving said agitating means reciprocatingly inside said duct.

According to a preferred embodiment, the agitating means comprise a number of agitating bodies, each with its axis perpendicular to the roller axis and tobacco feed direction, and each supported for rotation on a wall of the output portion of the duct, so as to oscillate about its own axis.

The agitating bodies are preferably arranged in a line extending substantially parallel to the roller axis, and each conveniently comprises a disk mounted for rotation inside a respective seat formed on the surface of the wall facing inwards of the duct; and a rib integral with and projecting from the respective disk inwards of the duct, and defined at the free end by a concave surface. Said ribs divide the output portion into a number of variable-direction channels.

BRIEF DESCRIPTION OF THE DRAWINGS

A non-limiting embodiment of the present invention will be described by way of example with reference to the accompanying drawings, in which:

FIG. 2 shows a larger-scale view of a detail in FIG. 1;

FIG. 3 shows a section along line III—III in FIG. 2;

FIG. 4 shows a section along line IV—IV in FIG. 2.

DETAILED DESCRIPTION OF THE INVENTION

Figure 1:
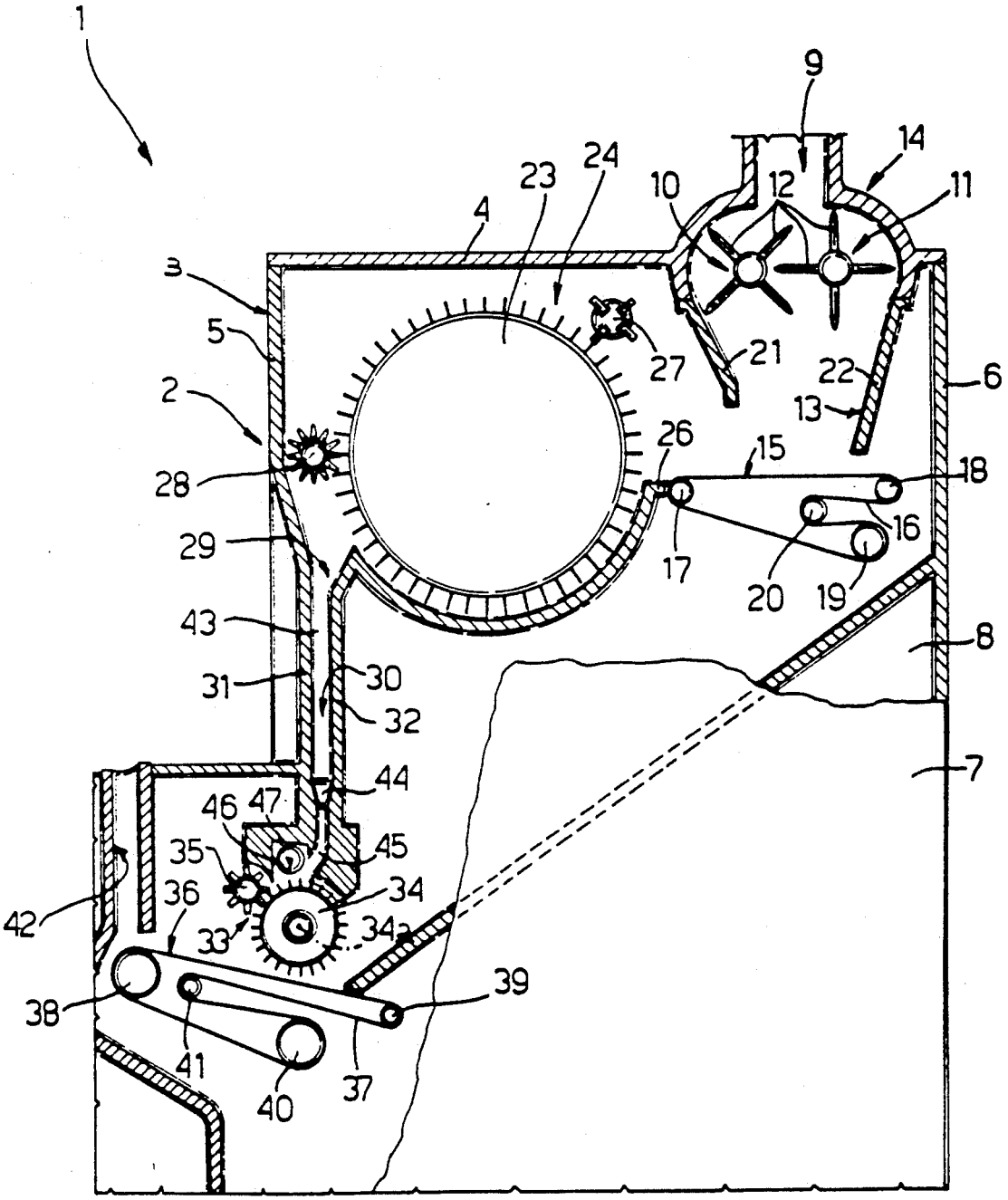
FIG. 1 shows a schematic section of a preferred embodiment of part of the cigarette manufacturing machine according to the present invention.

Number 1 in FIG. 1 indicates a cigarette manufacturing machine comprising a distributor 2 for forming a continuous, uniform stream of tobacco particles from a mass (not shown) of shredded tobacco.

Distributor 2 is housed inside a vertical casing 3 closed at the top by a horizontal wall 4, and laterally by two first vertical walls 5 and 6 and two second walls and 8 substantially parallel to the FIG. 1 plane.

Top wall 4 presents an opening for the passage of a rectangular-section input duct 9, at the bottom of which two powered rotary rollers 10 and 11, each having a number of outer peripheral radial teeth 12, are housed inside casing 3.

Rollers 10 and 11 rotate in opposite directions, and provide for pre-carding and feeding the tobacco into a chamber 13 underneath.

Together with rollers 10 and 11, duct 9 defines a pre-feed unit 14 over chamber 13, the bottom of which chamber 13 is defined by a conveyor belt 15 consisting of the top branch of a belt 16 looped about three guide rollers 17, 18 and 19, and about a tensioning roller 20.

The falling tobacco is directed on to conveyor belt 15 by two walls 21 and 22 converging in the direction of conveyor 15.

On the wall 21 side, chamber 13 is defined by a toothed carding roller 23 forming part of a carding or main feed unit 24, and located adjacent to the output end of conveyor 15.

Beneath and coaxial with roller 23, provision is made for a cylindrical cowling, one end of which supports a scraper element 26 extending between roller 23 and the output end of conveyor 15.

In addition to roller 23, unit 24 also comprises a so-called metering roller 27 rotating in the same direction as and substantially tangent to roller 23, and located between roller 23 and wall 4.

By virtue of the above arrangement, the tobacco fed by pre-feed unit 14 on to conveyor 15 underneath is fed by conveyor 15 through scraper element 26 and on to carding roller 23.

Outside chamber 13 and downstream from the point of tangency of carding roller 23 and metering roller 27, carding roller 23 transfers a layer of tobacco substantially equal in thickness to the radial size of its teeth.

The layer of tobacco on roller 23 is picked off by a toothed so-called hurling roller 28 by which it is hurled, in the form of separate particles, into a feedbox 29 communicating with the inlet of a substantially vertical duct 30 defined by two walls 31 and 32. At the bottom end, duct 30 presents an outlet facing a withdrawal unit 33 comprising a movable conveyor element facing said outlet and consisting of a toothed roller 34 for withdrawing the tobacco from duct 30 and rotating about an axis 34*a* parallel to the axis of carding roller 23.

Unit 33 also comprises a toothed hurling roller 35 by which the tobacco is picked off the teeth of roller 34 and hurled, in the form of separate particles, into a chamber having a bottom wall defined by an inclined, upward-moving collecting belt 36 traveling at a speed in the opposite direction to the surface speed of the point of roller 34 facing belt 36.

Belt 36 consists of the top branch of a belt 37 looped about three guide rollers 38, 39, 40 (at least one of which is powered) and maintained taut by tensioning roller 41.

Roller 38 is located adjacent to the bottom end of an upfeed duct 42, the top end (not shown) of which communicates with a continuous cigarette rod forming unit (not shown) wherein, as is known, the tobacco particles adhere to and form a continuous layer of tobacco (not shown) on the underside of at least one suction conveyor belt (not shown).

Still with reference to FIG. 1, duct 30 presents a substantially rectangular section, and comprises an upper input portion 43 connected to the output of feedbox 29; a downward-tapering intermediate portion 44; and an output portion 45.

The end portion of output portion 45 is defined by a feed roller 46 mounted for rotation about axis 47 and substantially tangent to roller 34.

With reference to FIGS. 2, 3 and 4, distributor 2 also comprises a homogenizing device 48 in turn comprising a number of agitating bodies 49, each extending partially inside output portion 45 of duct 30, and each supported for rotation on rear wall 50 of duct 30. More specifically, agitating bodies 49 are arranged in a line extending substantially parallel to axis 34*a*, and each presents a rotation axis 51 substantially perpendicular to axes 34*a* and 47 and to the tobacco feed direction A along duct 30.

Each agitating body 49 comprises a disk 52 mounted for rotation inside a respective seat 53 formed on the surface of wall 50 facing inwards of duct 30; and a diametrical rib 54 integral with disk 52, projecting from disk 52 inwards of output portion 45 of duct 30, and defined at the free end facing roller 46 by a concave surface 55.

As shown in FIG. 3, ribs 54 are arranged substantially parallel to direction A, so as to divide output portion 45 of duct 30 into a number of channels 56, the direction of which is varied continually, in use, by oscillating disks 52 about axes 51 via an activating device 57. For each disk 52, device 57 comprises a rod 58 engaging, in rotary and axially-fixed manner, a respective hole 59 formed in wall 50 and coaxial with axis 51; a crank 60 controlling rod 58; and a rod 61 common to all of agitating bodies 49 and moved reciprocatingly in a direction substantially parallel to axis 34*a*. More specifically, each rod 58 presents one end connected integral with a respective disk 52, and the opposite end connected in angularly integral manner to one end of respective crank 60, the opposite end of which pivots by means of a pin 62 on an intermediate portion of rod 61, so as to rotate about an axis 63 parallel to axis 51.

In actual use, when rod 61 is moved axially back and forth, each crank 60 rotates about axis 63, thus causing respective rod 58 and rib 54 to oscillate about axis 51, which oscillation of ribs 54 provides for substantially mixing the tobacco at the output of the duct and so improving the uniformity of the tobacco layer deposited on belt 36.

I claim:

1. A shredded tobacco distributor for use in a cigarette manufacturing machine, comprising:

a duct defined by walls and having an inlet portion and an output portion;

means for feeding shredded tobacco to said inlet portion of said duct to flow through said duct in a tobacco feed direction;

means for withdrawing the tobacco from said output portion of said duct, said withdrawal means comprising a rotating withdrawal roller having its axis of rotation perpendicular to the feed direction of the tobacco in said duct;

agitating means comprising a plurality of agitating bodies, each of said bodies having an axis perpendicular to the axis of said withdrawal roller and to the feed direction of the tobacco in said duct and each of said bodies being mounted for rotation about its axis on one of the walls in said output portion of said duct;

and activating means connected to said agitating means for oscillating said agitating bodies about their axes.

2. A distributor as claimed in claim 1, wherein said agitating bodies (49) are arranged in a line extending substantially parallel to the axis (34*a*) of said roller (34).

3. A distributor as claimed in claim 1, wherein each said agitating body (49) comprises a disk (52) mounted for rotation inside a respective seat (53) formed on the surface of said wall (50) facing inwards of said duct (30); and a rib (54) integral with and projecting from said disk (52) inwards of said duct (30); said ribs (54) each being defined at the free end by a concave surface (55), and dividing said output portion (45) into a number of variable-direction channels (56).

4. A distributor as claimed in claim 3, wherein said activating means comprise a plurality of first rods and a plurality of cranks, and a reciprocating rod common to all of said agitating bodies, each of said first rods having one end integral with a corresponding one of said disks and the opposite end angularly connected to one end of a corresponding one of said cranks, the other end of each of said cranks being pivotably connected to said reciprocating rod. the reciprocation of said reciprocating rod pivoting said cranks to thereby rotate said first rods and said disks about the axes of said agitating bodies.

* * * * *

UNITED STATES PATENT AND TRADEMARK OFFICE

CERTIFICATE OF CORRECTION

PATENT NO. : 5,331,977
DATED : July 26, 1994
INVENTOR(S) : Fiorenzo Draghetti

It is certified that error appears in the above-indentified patent and that said Letters Patent is hereby corrected as shown below:

On the Title page, item [73], Assignee: should read--G.D--.

Signed and Sealed this

Twenty-second Day of November, 1994

*Attest:*

Bruce Lehman

BRUCE LEHMAN

*Attesting Officer*

*Commissioner of Patents and Trademarks*